US006675611B2

(12) United States Patent
Hunter

(10) Patent No.: US 6,675,611 B2
(45) Date of Patent: Jan. 13, 2004

(54) NECKLACE MOUNT

(76) Inventor: Rebecca Kay Hunter, 540 NW. 45th, Oklahoma City, OK (US) 73118

( * ) Notice: Subject to any disclaimer, the term of this patent is extended or adjusted under 35 U.S.C. 154(b) by 23 days.

(21) Appl. No.: 09/906,360

(22) Filed: Jul. 16, 2001

(65) Prior Publication Data

US 2003/0010057 A1 Jan. 16, 2003

(51) Int. Cl.[7] ..... A44C 5/00

(52) U.S. Cl. ..... 63/3.1; 63/1.11; 63/1.16; 63/3

(58) Field of Search ..... 63/1.11, 1.16, 63/1.17, 3.1, 3, 21

(56) References Cited

U.S. PATENT DOCUMENTS 605,584 A * 6/1898 Muffly ..... 70/456 R
4,133,195 A * 1/1979 McLaren ..... 70/456 R
4,527,316 A * 7/1985 Murphy ..... 24/616
4,718,252 A * 1/1988 Fossas ..... 63/38
5,138,855 A * 8/1992 Faris ..... 70/457
6,279,244 B1 * 8/2001 Kelley ..... 33/514.1
6,293,034 B1 * 9/2001 Skapyak et al. ..... 40/310
6,401,488 B1 * 6/2002 Cousin et al. ..... 63/3

OTHER PUBLICATIONS

Tiffany & Co. keyring picture and transcript of ABC Good Morning America Nov. 1997.*

* cited by examiner

*Primary Examiner*—Andrea Chop

(57) ABSTRACT

A mount for retaining one or more necklaces is provided. The mount effectively retains two or more necklaces to keep them from becoming entangled together. The mount includes a loop of material to which the ends of the necklaces are mounted in turn. The ends of the necklaces may be mounted directly to the loop, but they are preferably mounted to loop connectors to extend away from the loop. Further, each of the loop connectors is preferably separated from its adjacent loop connector by a spacer. The spacer may be a decorative bead, for example, or an arced cylinder, to suit the wearer.

3 Claims, 1 Drawing Sheet

NECKLACE MOUNT

FIELD OF THE INVENTION

The present invention relates generally to the field of jewelry and, more particularly, to a mount to which a plurality of necklaces may be joined to prevent the necklaces from becoming entangled.

BACKGROUND OF THE INVENTION

Women, and even some men, often like to wear more than one necklace at a time. Each necklace is donned by coupling a hook or other appropriate means to an opposite end of the necklace. Unfortunately, when more than one necklace is worn at the same time, the necklaces often become entangled to one another. Also, the point of entanglement often becomes exacerbated by becoming entangled in the wearer's hair. Disentangling the necklaces from one another, and from the wearer's hair, can be a frustrating, tedious, and often painful experience.

Thus, there remains a need for a mount for keeping the necklaces arranged to prevent them from becoming tangled together.

SUMMARY OF THE INVENTION

The present invention addresses this need by providing a mount for retaining one or more necklaces. While the mount of this invention may be used with one necklace, it has been specifically designed to mount two or more necklaces to keep them from becoming entangled together.

The invention comprises primarily a loop of material to which the ends of the necklaces are mounted in turn. The ends of the necklaces may be mounted directly to the loop, but they are preferably mounted to loop connectors which extend away from the loop. Further, each of the loop connectors is preferably separated from its adjacent loop connector by a spacer. The spacer may be a decorative bead, for example, or an arced cylinder, to suit the wearer.

The ends of the loop mount may join together by any appropriate means, or they may be separated if the loop is formed of an adequately rigid material. One end of the loop may be formed of a sufficiently small diameter such that loop connectors and spacers can be interchanged on the loop, or, alternatively, the loop connectors and spacers can be made permanent on the loop. In this preferred alternative embodiment, the necklaces are simply attached to the loop connectors extending from the loop, and can be interchanged at the whim of the wearer.

BRIEF DESCRIPTION OF THE DRAWINGS

These and other features of the invention will be apparent to those of skill in the art from a review of the following detailed description along with the accompanying drawings.

DETAILED DESCRIPTION OF A PREFERRED EMBODIMENT

Figure 1:
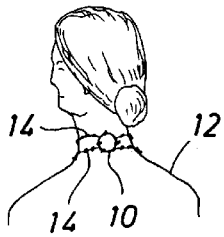
FIG. 1 is a perspective view of a woman wearing the mount of the present invention with two necklaces attached to the mount.

FIG. 1 illustrates a necklace mount 10 of this invention being worn by a wearer 12. In the example of FIG. 1, the wearer 12 has chosen to wear two necklaces 14 attached to the mount 10, although more necklaces may be worn with the mount. The mount may be conveniently worn at the nape of the neck of the wearer, and keeps the necklaces from becoming entangled together.

Figure 2:
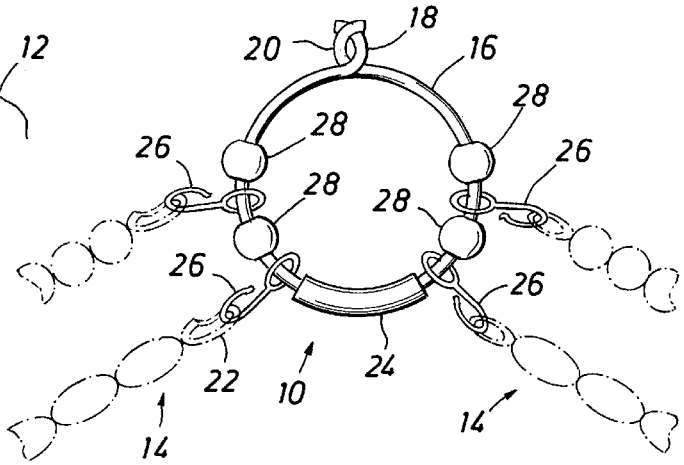
FIG. 2 is a plan view of the mount of this invention.

FIG. 2 depicts a presently preferred embodiment of the mount 10 to which necklaces 14, shown in phantom in FIG. 2, may be conveniently coupled. Necklaces commonly come with a male end and a female end, and the male and female ends are joined together to adorn the wearer. Thus, the essential parts of the present invention comprise at least two male coupling attachments, two female coupling attachments, and space between opposing pairs of such attachments. Many variations may be made to the combination of the elements, within the scope and spirit of the present invention, some of which are shown in the accompanying drawing figures and described below.

The mount 10 depicted in FIG. 2 includes a loop 16 having ends 18 and 20 which join together by any appropriate means, shown in FIG. 2 as intertwined. This means of attaching the ends 18 and 20 is simple and easy to use, and very inexpensive to use. Alternatively, a clasp 22, like one at the end of a typical necklace, may be used to join the ends 18 and 20. The loop 16 may be made of any convenient material, such as precious or semi-precious metal, or plastic.

Mounted in sliding engagement with the loop 16 are an elongated spacer 24, loop attachment clips 26, and spacer beads 28. In this embodiment, each of the spacer 24, the clips 26, and the beads 28 is detachable from the loop 16. The spacer is preferably made of a soft, flexible material if it is to be detachable from the loop; if it is to remain installed on the loop, it may be made of any appropriate material, even the same material as the loop. If the beads are detachable, they may be made of a variety of materials, shapes, and colors, to be mixed and matched at the whim of the wearer.

Figure 3:
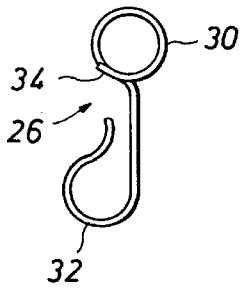
FIG. 3 is a plan view of a hook loop attachment which may be employed as a part of this invention.

As previously described, the mount 10 may include a set of clips 26. As shown in FIG. 2, the clips may be either male of female, since this design to adapted to attach to either the male or the female end of a necklace. One such clip 26 is shown in greater detail in FIG. 3. The clip includes a closed or semi-closed loop 30 and a crook 32. The loop 30 is adapted to attach firmly but slidably to the loop 16, and includes an opening 34 for that purpose. The crook 32 is designed so that the clip 26 can attach to the end of the necklace 14, or alternatively to a necklace string between two beads, for example, which form the necklace.

Figure 4:
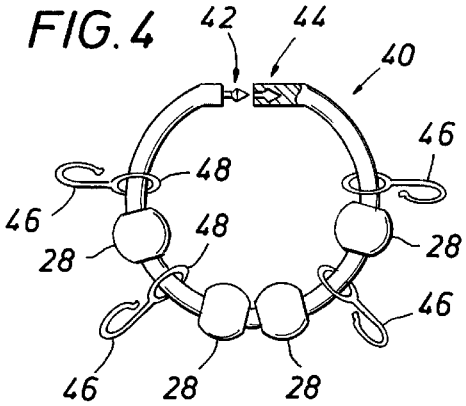
FIG. 4 is another plan view showing an alternative embodiment for joining the ends of the loop.

FIG. 4 depicts a preferred embodiment of the invention which is more closely adapted for use with less expensive costume or novelty jewelry. A mount 40, preferably formed of easily moldable plastic, includes a snap closure comprising a male end 42 and a female end 44, which quickly and easily snap together and unsnap apart. One advantage of the embodiment shown in FIG. 4 is that the ends 42 and 44 more easily accommodate the addition of spacer beads 28. In the embodiment of FIG. 4, two such beads 28 are shown adjacent one another at the bottom of the mount, although more may be used. A set of clips 46, are joined to the loop 40 as selected by the wearer. In this case, the clips include a closed loop end 48 and thus the clips can only be attached to the loop 40 by sliding onto one of the ends 42 or 44. The loop in this case, may be made of a semi-rigid material, or more likely a soft flexible material.

Figure 5:
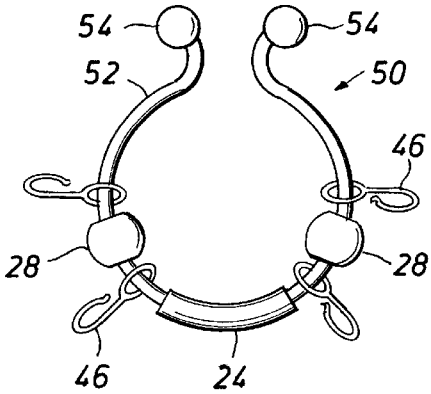
FIG. 5 is yet another plan view showing an embodiment of the invention in which the ends of the loop remain apart.

FIG. 5 depicts a mount 50 which includes an omega shaped holder 52 which is preferably made of a substantially rigid material. The holder includes end beads 54, which may be detachable or made permanently affixed to the holder 52. If the end beads 54 are to be affixed to the holder, then the cylindrical spacer 24, the clips 46, and the spacer beads 28 must be mounted onto the holder 50 before the attachment of the end beads 54.

Figure 6:
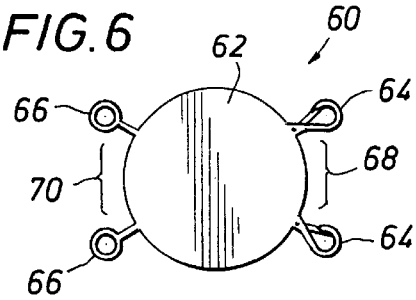
FIG. 6 depicts a preferred embodiment of the invention including a solid disk with protruding necklace attachments.
Figure 7:
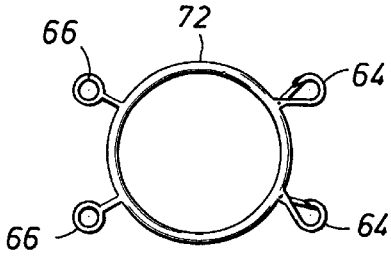
FIG. 7 depicts an embodiment similar to FIG. 6, in which the solid disk is replaced with a loop.

FIGS. 6 and 7 illustrate the most basic embodiment of the present invention. A mount 60 comprises a solid disk 62, a pair of clips 64 adapted to receive the female ends of two necklaces, and a pair of clips 66 adapted to receive the male ends of the necklaces. The solid disk 62 provides a space 68 between the clips 64 and a space 70 between the clips 66.

The embodiment depicted in FIG. 7 is similar to the mount shown in FIG. 6, except that in the place of the solid disk 62 is a circular or other shaped ring 72. In both FIG. 6 and FIG. 7, decorative beads or other adornment may be used, but are not essential to the functioning of the mount. The clips, in this case, are fixed in place either to the disk 62 or to the ring 72.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A necklace mount system comprising:

a. an arcuate hoop body;

b. a plurality of removable necklace receiving attachments, each of the plurality of necklace receiving attachments comprising a loop around the hoop body and a hook member extending from the loop, the necklace receiving attachments being adjustable with respect to each other;

c. a plurality of removable means for maintaining an adjustable space between each of the necklace receiving attachments and d. a necklace having two ends, each of the two ends being attachable to respective attachments of the plurality of necklace receiving attachments.

2. The necklace mount of claim 1, wherein the plurality of removable means for maintaining an adjustable space between each of the necklace receiving attachments comprise beads, and wherein at least one of the beads is different than one of the other beads.

3. The necklace mount of claim 2, wherein at least one of the beads defines an arcuate length along the hoop body, and further comprising an elongate spacer defining a spacer length along the hoop body that is longer than the arcuate length of the at least one of the beads.

* * * * *